US008191643B2

(12) United States Patent
Nutley et al.

(10) Patent No.: US 8,191,643 B2
(45) **Date of Patent: *Jun. 5, 2012**

(54) DOWNHOLE APPARATUS WITH A SWELLABLE SEAL

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 59 days.

This patent is subject to a terminal disclaimer.

(21) Appl. No.: 12/470,406

(22) Filed: May 21, 2009

(65) Prior Publication Data

US 2009/0272546 A1 Nov. 5, 2009

Related U.S. Application Data

(63) Continuation of application No. PCT/GB2007/004454, filed on Nov. 21, 2007.

(30) Foreign Application Priority Data

Nov. 21, 2006 (GB) ..... 0623138.5
May 31, 2007 (GB) ..... 0710384.9

(51) Int. Cl.
*E21B 33/12* (2006.01)

(52) U.S. Cl. ..... 166/387; 166/180; 166/241.6

(58) Field of Classification Search ..... 166/387, 166/386, 180, 118, 241.4, 241.6; 277/336; 285/123.12

See application file for complete search history.

(56) References Cited

U.S. PATENT DOCUMENTS 2,515,149 A 7/1950 Willhoit
3,578,084 A * 5/1971 Bombardieri et al. ..... 166/288
3,918,523 A 11/1975 Stuber
3,963,075 A * 6/1976 Evans ..... 166/241.6
4,137,970 A 2/1979 Laflin et al.
4,892,144 A 1/1990 Coone
5,027,894 A 7/1991 Coone (Continued)

FOREIGN PATENT DOCUMENTS

CA 2565220 4/2008

(Continued)

OTHER PUBLICATIONS

International Written Opinion and Search Report regarding international application No. PCT/GB2007/004454, dated Mar. 18, 2008.

(Continued)

*Primary Examiner* — David Bagnell
*Assistant Examiner* — Nicole A. Coy
(74) *Attorney, Agent, or Firm* — Wong, Cabello, Lutsch, Rutherford & Brucculeri, L.L.P.

(57) ABSTRACT

A downhole apparatus for location on a tubular, an assembly, and a method of use are described. The apparatus comprises a body with a throughbore configured to receive a tubular, and at least one swellable member that comprises a material selected to expand upon exposure to at least one predetermined fluid. The swellable member is arranged to provide a seal between the body and a tubular on which it is located during use, for example in a micro-annulus between the body and the tubular. Advantageously, the apparatus may be configured such that the body is moveable on the tubular before expansion, which may permit the apparatus to be slipped or slid onto the tubular into its desired location. The apparatus may be configured to rotate or slide on the tubular.

37 Claims, 4 Drawing Sheets

U.S. PATENT DOCUMENTS

| | | | | |
|---|---|---|---|---|
| 5,810,100 | A * | 9/1998 | Samford | 175/325.3 |
| 6,032,748 | A * | 3/2000 | DeBray et al. | 175/325.7 |
| 6,581,682 | B1 | 6/2003 | Parent et al. | |
| 7,431,098 | B2 | 10/2008 | Ohmer et al. | |
| 7,604,059 | B2 * | 10/2009 | Thornton | 166/381 |
| 7,699,111 | B2 * | 4/2010 | Brooks et al. | 166/373 |
| 7,784,550 | B2 | 8/2010 | Nutley et al. | |
| 7,896,085 | B2 | 3/2011 | Nutley et al. | |
| 2004/0055758 | A1 | 3/2004 | Brezinski et al. | |
| 2004/0112609 | A1 | 6/2004 | Whanger et al. | |
| 2005/0110217 | A1 | 5/2005 | Wood et al. | |
| 2006/0042801 | A1 | 3/2006 | Hackworth et al. | |
| 2006/0124310 | A1 | 6/2006 | Lopez de Cardenas et al. | |
| 2006/0175065 | A1 | 8/2006 | Ross | |
| 2007/0144733 | A1 | 6/2007 | Murray et al. | |
| 2007/0246213 | A1 * | 10/2007 | Hailey, Jr. | 166/278 |
| 2007/0246225 | A1 * | 10/2007 | Hailey et al. | 166/386 |
| 2008/0110626 | A1 | 5/2008 | Allison et al. | |
| 2009/0139707 | A1 | 6/2009 | Berzin et al. | |
| 2009/0179383 | A1 | 7/2009 | Koloy et al. | |
| 2009/0272525 | A1 | 11/2009 | Nutley et al. | |
| 2010/0051294 | A1 | 3/2010 | Nutley et al. | |
| 2010/0051295 | A1 | 3/2010 | Courville et al. | |

FOREIGN PATENT DOCUMENTS

| | | | |
|---|---|---|---|
| EP | 1437480 | | 7/2004 |
| GB | 2201176 | A | 8/1988 |
| GB | 2411918 | | 11/2006 |
| GB | 2416796 | | 2/2007 |
| WO | 9949180 | | 9/1999 |
| WO | 0220941 | | 3/2002 |
| WO | 2005052308 | A | 6/2005 |
| WO | 2006121340 | | 1/2006 |
| WO | 2006053896 | | 5/2006 |

OTHER PUBLICATIONS

International Written Opinion and Search Report regarding corresponding application No. PCT/GB2007/004443, dated Apr. 4, 2008.

International Written Opinion and Search Report regarding corresponding application No. PCT/GB2007/004445, dated Mar. 14, 2008.

International Written Opinion and Search Report regarding corresponding application No. PCT/GB2007/004453, dated Mar. 18, 2008.

* cited by examiner

DOWNHOLE APPARATUS WITH A SWELLABLE SEAL

CROSS-REFERENCE TO RELATED APPLICATIONS

This application claims priority to PCT application PCT/GB2007/004454, filed Nov. 21, 2007, which in turn claims priority to United Kingdom Patent Application No. GB0623138.5, filed on Nov. 21, 2006 and United Kingdom Patent Application No. GB0710384.9, filed on May 31, 2007.

FIELD OF THE INVENTION

The present invention relates to a downhole apparatus, a downhole assembly, and a method of use, and in particular to a downhole apparatus and method for creating a seal between wellbore components.

BACKGROUND

In the fields of wellbore construction and well intervention, it is common to run tools and components to downhole locations on tubulars. For example, a packer or other isolation tool may be run on a casing string to provide isolation between borehole sections. The packer will be inflated or expanded into contact with an outer casing, to create a seal in the annulus between the outer casing and the casing on which the packer is run. To provide an effective seal, fluid must be prevented from passing through the space or micro-annulus between the packer and the casing, as well as between the casing and the outer casing. In many other downhole applications it is desirable to create a seal between a tubular and a body mounted on a tubular.

Previously proposed seal arrangements for sealing between a body and a tubular either rely on an interference fit between the body and a tubular, for example an o-ring seal, or they are relatively complex in construction and/or require particular activation conditions.

Providing an o-ring seal between two downhole components may be acceptable in some circumstances, but the requirement for an interference fit may be undesirable in others. For example, where the tools are slip on tools, which are slipped onto a tubular at surface and into the desired location, an interference fit makes the assembly process less convenient. In addition, during run-in of the tool on a tubular, the tool is likely to be subject to forces having axial, radial, and torsional components. These forces may be transferred to the o-ring, creating a risk of damage to the seal. In addition, o-rings may react unfavourably to some wellbore fluids.

In other applications, it may be desirable for a tool to be free to rotate and/or slide (between axial limits) during run-in, for example in friction reducing and centralising applications.

SUMMARY

It is amongst the aims and objects of the invention to provide an improved downhole apparatus, downhole assembly, and seal arrangement therefor, compared with the prior art. Further aims and objects of the invention will become apparent from the following description.

According to a first aspect of the invention, there is provided a downhole apparatus for location on a tubular, the apparatus comprising a body having a throughbore configured to receive a tubular therethrough, and at least one swellable member which comprises a material selected to expand upon exposure to at least one predetermined fluid, wherein the swellable member is arranged to provide a seal between the body and a tubular on which it is located during use.

The downhole apparatus according the invention uses a swellable member, which may be activated by exposure to wellbore fluid, to create a seal between two wellbore components, which may be for example components of an wellbore completion or an intervention apparatus. The apparatus may have a first condition in which the swellable member is not expanded, and a second condition in which the swellable member is expanded and the seal is provided. The apparatus may be configured such that no seal is provided between the tubular and the body when the apparatus is in its first condition.

Advantageously, the apparatus may be configured such that the body is moveable on the tubular when the swellable member is in its first condition. This may permit the apparatus to be slipped or slid onto the tubular into its desired location. The apparatus may be configured to rotate on a tubular, and may be configured to slide on the tubular.

The apparatus may be configured for location on a casing or liner. The apparatus may be an isolation tool, such as a packer, a centraliser, such as a casing centraliser, a stabiliser, or an anchor or hanging device. The apparatus may be configured for use in an openhole bore or in a cased or otherwise lined borehole. The apparatus may comprise a sliding sleeve which forms the body, which slides on a tubular within set limits to perform a particular function.

The apparatus may alternatively be a collar such as a stop collar or a drill collar, an end connector, end ring or a joint.

The swellable member may be configured to extend around the tubular during use, and may provide a seal between an upper volume of an annular space, defined between the body and the tubular located above the seal, and a lower volume of the annular space located below the seal.

The apparatus may comprise a plurality of swellable members, which together extend around the tubular in use to create a seal between an upper volume of an annular space, defined between the body and the tubular located above the seal, and a lower volume of the annular space located below the seal. The annular space may be a micro-annulus.

The apparatus may be configured such that the at least one swellable member is disposed least partially between the body and tubular in use.

The body may comprise a substantially cylindrical portion. The throughbore may be sized to receive a tubular with a clearance fit. The throughbore may be at least partially defined by the swellable member. Preferably, the apparatus is configured such that the swellable member provides full bore clearance for a tubular.

The body may comprise a cross-section which varies along its length. The body may comprise one or more formations in which the at least one swellable member is located. The one or more formations may comprise a recess in the inner diameter of the throughbore. The one or more formations may comprise an aperture, slot, or window formed in the body. The one or more formations may face inwardly of the apparatus, and may comprise an annular formation. The one or more formations may extend circumferentially around the body.

The body may comprise a first portion and a second portion longitudinally spaced from the first portion. The first and second portions may be cylindrical, and the inner dimensions of the first and second portions may partially define the inner diameter of the body.

The body may comprise one or more joining portions configured to join the first and second portions. The one or more joining portions may be of unitary construction with the first and/or second portions. Alternatively, or in addition, the one or more joining portions may be welded or otherwise fixed to one or both of the first or second joining portions.

In one embodiment, the joining portion has an inner diameter greater than the inner diameter of the first and second portions. The joining portion therefore may define an annular formation between the first and second portions, in which the seal may be created.

The joining portion may comprise one or more fingers. The joining portion may comprise a joining ring. The joining portion may partially overlap the first and second portions on an outer surface of the first and second portions. Alternatively, the joining portion may partially overlap the first and second portions on an inner surface of the first and second portions. In this latter case, the joining portion may define the inner diameter of the body and the swellable member may be received in a formation between the joining portions.

The one or more joining portions may comprise a finger or bow which has a maximum outer diameter at a cross-section located between the first and second portions. Alternatively, or in addition, the one or more joining portions may comprise a finger or bow which has a maximum inner diameter at a cross section between the first and second portions. The finger or bow may have an arcuate profile. The finger or bow may be configured to provide stand off protection to the tubular in use, and may be configured to flex or deform on exposure to a radial or axial load.

The body may comprise a plurality of joining portions distributed circumferentially around the body. The joining portions may define apertures, windows, or slots therebetween.

The apparatus may be provided with one or more support portions which partially define inner surface of the body. The support portions may define formations in which the swellable member is received. Such formations may be defined between adjacent support portions, or between a support portion and a joining portion.

The at least one swellable member may be configured to provide isolation between an upper volume of an annulus of a bore in which it is located above the seal, and a lower volume of the annulus of the bore located below the seal. The at least one swellable member may therefore provide a seal with an outer casing, a liner or openhole in use. In one embodiment, the at least one swellable member is configured to provide a seal with cement located in the annulus. Accordingly, the swellable member may provide a seal between the tubular and the bore in which it is located. The seal may be continuous between the tubular and the bore in which the tubular is located.

The apparatus may comprise a plurality of swellable members, which may be longitudinally spaced on the body. The apparatus may comprise one or more swellable members disposed on the outer surface of the body, and may comprise an outer sheath of swellable material. One or more swellable members may extend along a part of a length of the apparatus.

In one embodiment, the swellable member is configured to form a seal over an opening to a volume between the body and a tubular on which the body is located. The volume may be an annular space and the swellable member may be configured to cover an opening to the annular space, which may be at an end of the body. The swellable member may in this embodiment provide a seal between the tubular and the bore in which it is located.

The apparatus may comprise one or more formations machined, milled, or routed into the body. In one embodiment, the one or more formations are an annular groove, and the swellable member may be a ring shaped to fit in the annular groove. The swellable member may be a cylindrical ring, and may be sized to form an interference fit with the formation. The swellable member may be sized to be flush with an inner profile of the body. The swellable member may be moulded, for example injection moulded or compression moulded, with the apparatus. Alternatively, the swellable member may be bonded to the body, for example with adhesive.

According to a second aspect of the invention there is provided a downhole assembly comprising a tubular and an apparatus, the apparatus comprising a body and at least one swellable member which comprises a material selected to expand upon contact with at least one predetermined fluid, wherein the tubular extends through a bore defined by the body and the swellable member is arranged to provide a seal between the body and the tubular.

The downhole assembly may comprise an apparatus according to the first aspect of the invention of any of its preferred and optional features.

The downhole assembly may have a first condition in which the swellable member is not expanded, and a second condition in which the swellable member is expanded and the seal is provided. The assembly may be sized for a clearance fit on a tubular when in its first condition. The assembly may be configured such that no seal is provided between the tubular and the body when the apparatus is in its first condition. Advantageously, the apparatus may be configured such that the body is moveable on the tubular when the swellable member is in its first condition. This may permit the apparatus to be slipped or slid onto the tubular into its desired location to create the assembly. The apparatus may be configured to rotate on the tubular, and may be configured to slide on the tubular. The assembly may be configured such that the apparatus does not rotate on the tubular when the swellable member is in its expanded condition.

The assembly may comprise a plurality of apparatus according to the first aspect of the invention or any of its preferred and optional features.

The assembly may further comprise one or more stops mounted on the tubular to restrict axial movement of the apparatus on the tubular.

According to a third aspect of the invention there is provided a method of forming a downhole assembly, the method comprising the steps of: locating a body on a tubular, such that the tubular extends through a bore defined by the body; running the tubular to a downhole location; and creating a seal between the body and the tubular by exposing a swellable member to at least one predetermined fluid to expand the swellable member.

The method may comprise the step of slipping or sliding the body onto the tubular, and such step may be carried out at surface. The body may be run to a downhole location with the tubular.

The body and the swellable member may form the apparatus of the first aspect of the invention or any of its preferred or optional features. The method may comprise the additional step of locating one or more stops on the tubular to restrict axial movement of the body on the tubular. The apparatus/method of the second aspect of the invention may include one or more features of first aspect or its preferred embodiments.

DETAILED DESCRIPTION

Figure 1:
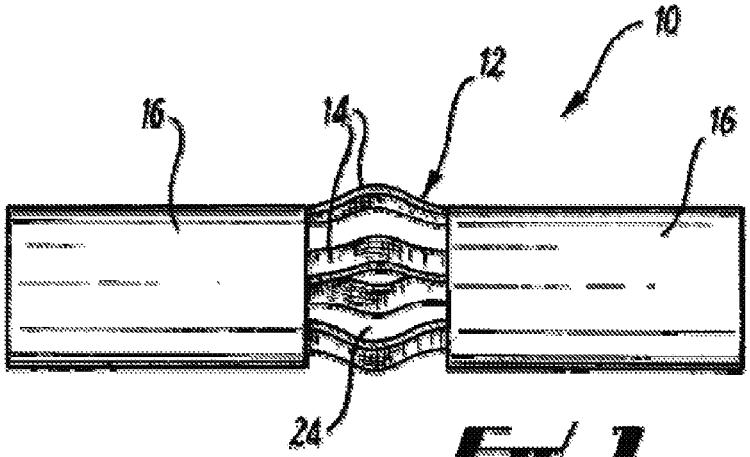
FIG. 1 is a side view of an apparatus in accordance with a first embodiment of the invention.
Figure 2:
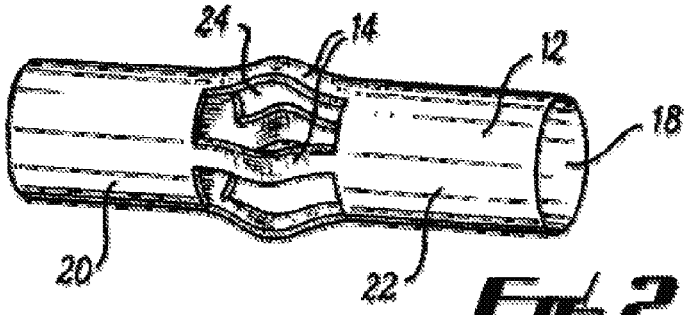
FIG. 2 is a perspective view of a component of the apparatus of FIG. 1.
Figure 3:
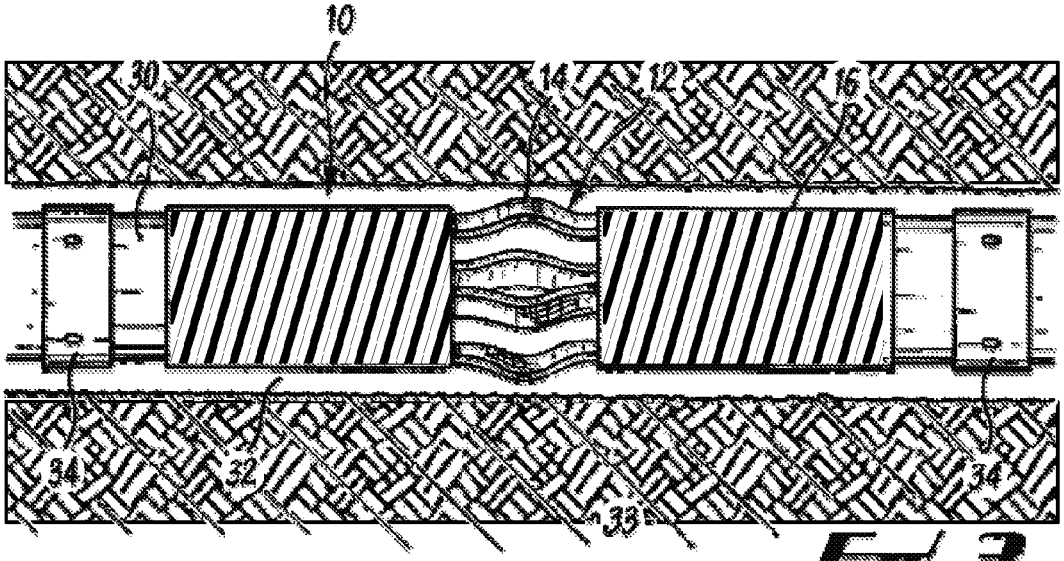
FIG. 3 is a schematic view of the apparatus of FIG. 1 in situ in a downhole environment.

Referring firstly to FIGS. 1, 2 and 3, there is shown an apparatus, generally depicted at 10, consisting of a body 12, formations upstanding from the body in the form of fingers or bows 14, and sheaths 16. As most clearly shown in FIG. 2, the body 12 is substantially cylindrical and defines a throughbore 18. The body 12 consists of a first portion 20 and a second portion 22, both of which are cylindrical are separated in a longitudinal direction of the body 12. The fingers 14 form joining portions for the first and second portions 20, 22 and have a maximum outer and inner diameter at a cross-section located between the first and second portions 20, 22. The fingers have an arcuate profile, and are configured to provide stand off protection to the tubular in use, and to flex or deform on exposure to a radial or axial load. Between the fingers 14 are apertures 24 located in the body.

In this embodiment, the body 12 is formed from a metal such as steel (although plastics, ceramics, or composites could be used in other embodiments). The body is formed from a flat sheet of metal, from which the apertures 24 are laser cut. The flat sheet is deformed to create a linear series of fingers, the sheet is wrapped around a cylindrical mandrel, and the two opposing edges of the sheet are welded together to create a cylinder. The sheaths 16 are cylindrical and are formed to extend over the first and second portions 20, 22. In this embodiment, the sheaths 16 are formed from a swellable material which expands on exposure to at least one predetermined fluid.

FIG. 3 shows the apparatus 10 in use on a tubular 30 located in a wellbore 32 in a formation 33. The apparatus 10 is slipped onto the tubular 30 such that the tubular extends through the bore 18. The apparatus 10 forms a clearance fit with the tubular 30 such that it easily slips on to the tubular 30 to its desired location and is free to rotate on the tubular. Located on the tubular and axial locations separated from the ends of the apparatus 10 are stop collars 34. Stop collars 34 are secured to the tubular 30, and restrict axial movement of the apparatus tubular in use.

The body 12 is a rigid assembly which provides stand off to the apparatus and the tubular during run-in, to allow the apparatus to perform a centralising function. The body 12 also provides rigidity and structure to the apparatus 10, allowing it to be assembled on the tubular simply by slipping the apparatus over an end of the tubular at surface and into its desired location. The rigidity and structure provided by the body 12, also allows the apparatus to rotate on the tubular during run-in, which assists in reducing friction and wear to the tubular being run.

Figure 4:
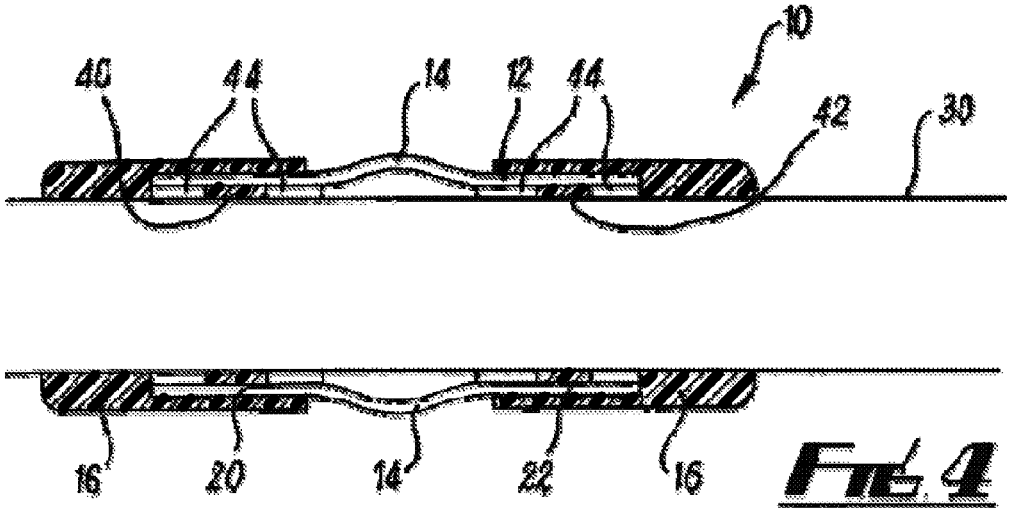
FIG. 4 is a sectional view through the apparatus of FIG. 1 on a tubular.

FIG. 4 is a sectional view showing apparatus 10 located on a tubular 30. The apparatus is provided with support portions 44 which partially define inner surface of the body 12. The support portions 44 in this embodiment are metal rings which are welded to the inner surfaces of the first and second portions 20, 22, and thus provide support to the body 12 on the tubular around the circumference of the body. The support portions 44 define formations or recesses in which swellable members 40, 42 are received. The swellable members are formed from a material which expands on exposure to at least one predetermined fluid, and in this embodiment form a cylindrical ring which extends around the tubular in use. The inner diameter of the swellable members 40, 42 is such that the in the dimensions of the swellable member are flush with or recessed to the throughbore defined by the body and the support portions. This allows the apparatus to have a clearance fit with the tubular 30 during assembly and run-in.

FIG. 4 also shows that the sheath 16 extends beyond the ends of the body 12. The inner diameter of the sheath 16 is also formed to be flush with or enlarged with respect to the body and the support portions, thereby maintaining the clearance fit during an assembly and run-in.

When the assembled apparatus 10 and tubular 30 reach their desired location in a wellbore, they will be exposed to wellbore fluids. Fluid penetrating the annular space (or micro-annulus) between the apparatus 10 and the tubular 30 will come into contact with the swellable members 40 and 42. Exposure of the swellable members to the wellbore fluid will cause it to expand. Expansion in a radial direction will push the swellable members 40, 42 against the body 12 and the tubular 30, and will create a seal between the two components.

The embodiment of FIGS. 1 to 4 is configured in particular for use in a cementing application. The apparatus 10 forms a centralising function during run-in, and when the tubular is at its desired location, cement is pumped into the annulus between the tubular and the formation to secure the tubular. The swellable members 40, 42 create a fluid seal between the apparatus 10 and the tubular 30 which improves the integrity of the cement job. In this embodiment, sheaths 16 are also made from a swellable material and function to create a seal between the tubular and the cement. The sheath 16 is also configured to form a seal over an opening to the micro-annulus between the body and the tubular on which the body is located.

The invention therefore provides a seal which can be activated downhole by exposure to wellbore fluid. The apparatus therefore has a first condition, in which the swellable member is not expanded, and a second condition in which the swellable member is expanded and the seal is provided. The apparatus is moveable on the tubular when the swellable member is in its first condition, permitting the apparatus to be slipped or slid onto the tubular into its desired location to create the assembly, and allowing rotation during run-in.

Figure 5:
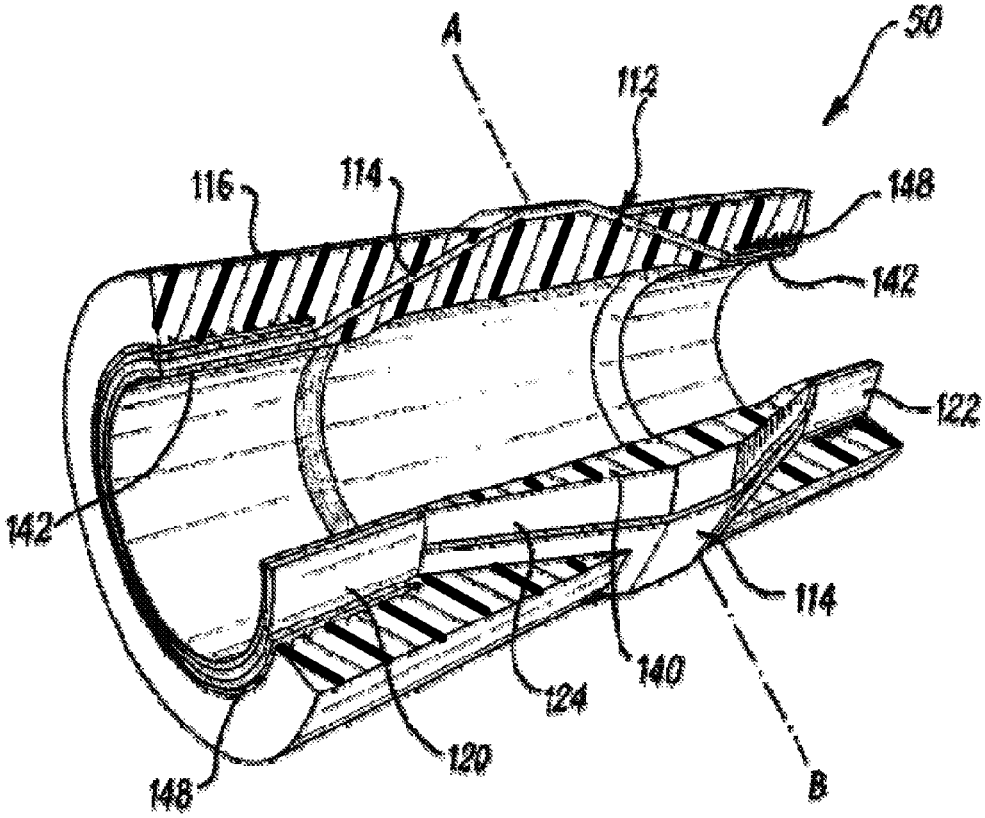
FIG. 5 is a part-sectional view of an apparatus in accordance with a second embodiment of the invention.

Referring now to FIG. 5, there is shown an apparatus in accordance with an alternative embodiment of the invention, generally depicted at 50. The apparatus comprises a body 112 consisting of first and second portions 120, 122 and joining portions in the form of fingers 114. Apertures 124 are formed in the body 112. The body 112 is formed a similar manner to the body 12 of FIGS. 1 to 4, although it differs in that the fingers 114 are angular rather than arcuate. The fingers 114 have a maximum outer and inner diameter at a part cylindrical portion located between the first and second portions 120, 122. Similarly to FIGS. 1 to 4, the fingers are configured to provide stand off protection to the tubular in use, and to flex or deform on exposure to a radial or axial load. The body 112 performs the same function as in the embodiment of FIGS. 1 to 4.

In this embodiment, the apparatus comprises a swellable member 140, a part of which is located in a formation created by the profile of fingers 114. At a cross-section at line A-A, the swellable member 140 forms a continuous ring around the circumference of the apparatus, and provides a seal between the body and the tubular in use. Swellable material is also formed on the outer surface of the body 112 at 116, which in use provides an outer seal between the body 112 and the bore in which it is located. The swellable member is continuous through the apertures 124 in the body, although in other embodiments may be integrally formed from multiple swellable components.

The swellable member 140 extends to portions 142 between the first and second portions, to form thin inner sheath of swellable material. The inner diameter of the apparatus defined by the swellable material is such that there is a clearance fit with a tubular on which the apparatus is located. The apparatus 50 may be slipped onto the tubular, and may be free to rotate on the tubular during assembly and run-in. Subsequent expansion of the swellable member by exposure to wellbore fluids creates an inner seal between the body 112 and the tubular (and also in this case an outer seal with the bore).

The apparatus 50 is also provided with mating profiles 148 permitting the apparatus to be coupled to other downhole components by means of suitable connectors.

FIGS. 6 to 10 are sections through parts of apparatus in accordance with alternative embodiments of the invention, having different sealing arrangements. Only a half section of one end of the apparatus is shown for brevity, with the remaining parts of the body being identical to body 12. However, the sealing arrangements shown are suitable for use on any body and tubular assembly having the features of the invention. Operation of the embodiments of FIGS. 6 to 10 is as described above.

Figure 6:
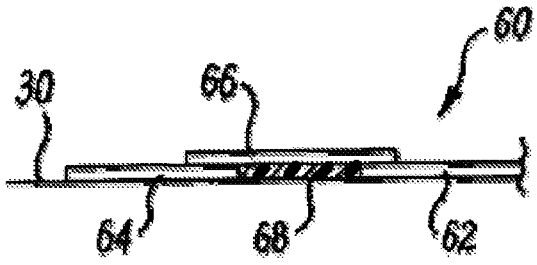
FIG. 6 is a detailed sectional view of a sealing arrangement in accordance with an alternative embodiment of the invention.

In the example of FIG. 6, the body 60 comprises a first cylindrical portion 62 of the body and a further cylindrical portion 64 axially separated from the portion 62. A joining portion 66 partially overlaps the portions 62 and 64 on their outer surfaces, and together the portions 62, 64, and 66 define an annular recess in which a swellable member 68 is received. The joining portion is an over ring secured to the body 60, for example by welding. The swellable member 68 is expanded in use to provide a seal with the tubular 30.

Figure 7:
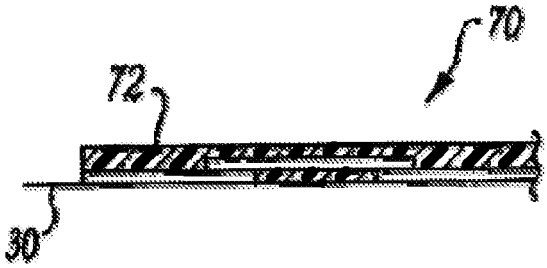
FIG. 7 is a detailed sectional view of a sealing arrangement in accordance with a further embodiment of the invention.

FIG. 7 shows a variation 70 on the embodiment of FIG. 6, in which a sheath 72 of swellable material is provided over a part of the outer surface of the body. The sheath 72 functions to provide an outer seal between the body and a bore in which it is located.

Figure 8:
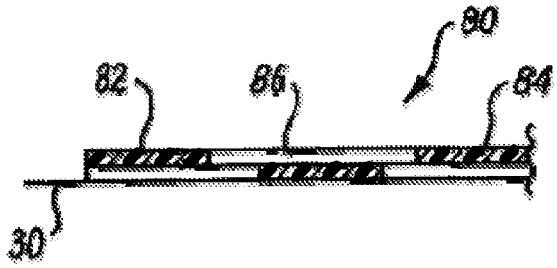
FIG. 8 is a detailed sectional view of a sealing arrangement in accordance with a further embodiment of the invention.

FIG. 8 shows a variation 80 on the embodiment of FIG. 7, wherein a swellable material 82, 84 is provided over a part of the outer surface of the body in discrete sections. The outer layer of a swellable material is configured to be substantially flush with the outer surface of the joining portion 86.

Figure 9:
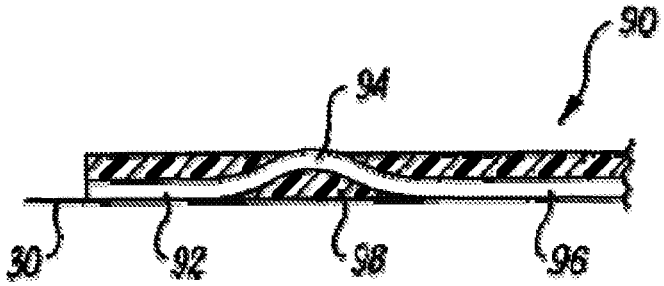
FIG. 9 is a detailed sectional view of a sealing arrangement in accordance with a further embodiment of the invention.

A further alternative embodiment of the invention shown in FIG. 9 generally at 90. In this variation, a plurality of apertures (not shown) are provided in the body, for example by the method described with reference to FIGS. 1 to 4. A plurality of fingers 94 circumferentially distributed on the body for joining portions between cylindrical sections 92 and 96. In a similar manner to the fingers 14 in FIGS. 1 to 4, the fingers create a formation of increased outer and inner diameter, and a swellable member 98 forms a continuous ring around the tubular 30, which is expanded in use to create a seal.

Figure 10:
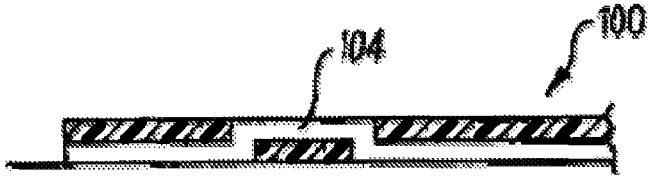
FIG. 10 is a detailed sectional view of a sealing arrangement in accordance with a further embodiment of the invention.

FIG. 10 shows a variation 100 on the embodiment of FIG. 9, in which the fingers 104 have a rectangular profile as opposed to the arcuate profile of the fingers in the embodiment of FIG. 9.

Figure 11:
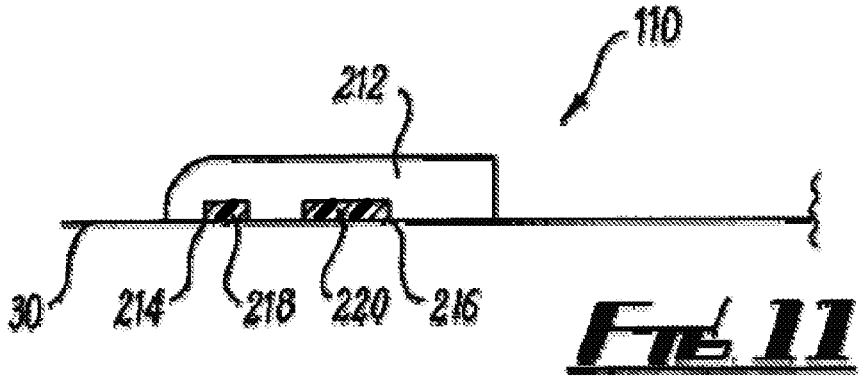
FIG. 11 is a detailed sectional view of a collar in accordance with a further embodiment of the invention.

FIG. 11 is a schematic view of a further alternative embodiment of the invention, as applied to a collar, generally depicted at 110. The collar 110 is symmetrical about a longitudinal axis, and only a half section of one end of the apparatus is shown for brevity. The collar 110 comprises a body 212 which has a throughbore sized to provide a clearance fit with a tubular 30. The body 212 comprises recesses 214, 216, which in this case are milled, annular recesses is formed in the inner surface of the body 212. The recesses 214, 216 respectively receive swellable members 218, 220, which may be expanded to provide a seal between the body 212 and a tubular by exposure to a wellbore fluid. The collar 110 is in this example a stop collar, which may be slipped onto a tubular to its desired location, and secured to the tubular by, for example, bolts (not shown).

Figure 12:
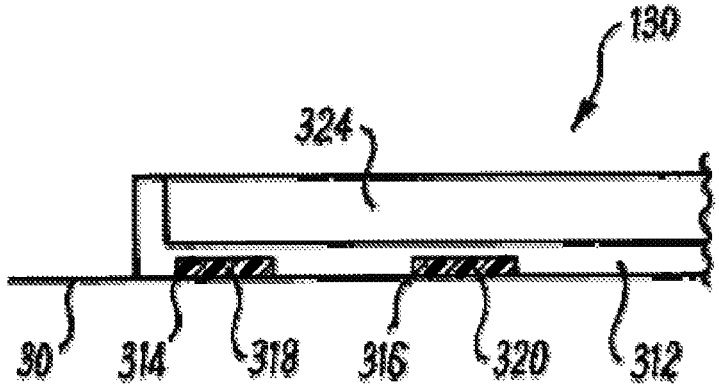
FIG. 12 is a detailed sectional view of a packer in accordance with a further embodiment of the invention.

FIG. 12 is a schematic view of a further embodiment of the invention, as applied to a wellbore packer, shown generally at 130. The packer 130 comprises a body 312, of which is mounted a packer component 324. The body 312 comprises recesses 314, 316, which in this case are milled, annular recesses is formed in the inner surface of the body 312. The recesses 314, 316 respectively receive swellable members 318, 320, which may be expanded to provide a seal between the body 312 and a tubular by exposure to a wellbore fluid. The packer is in this example an inflatable packer, but could equally be another class of packer such as a swellable packer or a mechanical packer. The packer 130 may be slipped onto a tubular to its desired location, and secured to the tubular by, for example, stop collars (not shown). When the packer component 324 is activated, it will create an outer seal between the body 312 and the bore in which it is located. The swellable members 314, 316 may be expanded to provide a seal between the body 312 and a tubular by exposure to a wellbore fluid.

Figure 13:
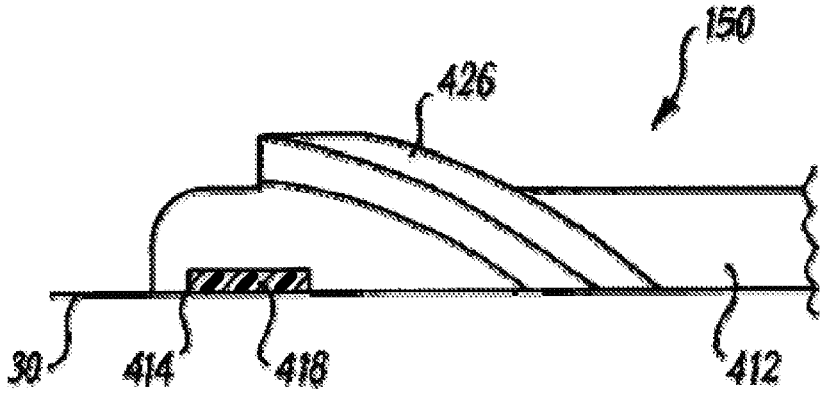
FIG. 13 is a detailed sectional view of a centraliser in accordance with a further embodiment of the invention.

A further embodiment of the invention is illustrated schematically in FIG. 13, which shows a solid centraliser, generally depicted at 150. The centraliser comprises a main body 412 with blades 426 mounted on the body. The centraliser is in this example a casing centraliser, and the blades 426 are shaped to provide stand off and to create a turbulent flow in mud and cement which passes the centraliser. The body 412 comprises a recess 414 which in this case is a milled, annular recess formed in the inner surface of the body 412. The recess 414 receives a swellable member 418, which may be expanded to provide a seal between the body 412 and a tubular by exposure to a wellbore fluid.

It should be appreciated that the recesses in embodiments of FIGS. 11 to 13 may be formed by another means, for example by defining formations by providing support portions or joining portions the manner of the embodiments of FIGS. 1 to 10. In variations to the embodiments described above, the joining portions in the form of fingers with apertures therebetween may instead be continuous, ring-type joining portions without apertures. Similarly, apertures may be formed in the ring-type joining sections.

In an alternative embodiment of the invention, the body is coupled to a tubular by a threaded connection, and the swellable member provides a seal adjacent the threaded coupling. In this embodiment, the tubular may not extend completely through the throughbore.

The present invention provides a swellable member, which may be activated by exposure to wellbore fluid, to create a seal between two wellbore components, which may be for example components of a wellbore completion or an intervention apparatus. The invention offers the advantage that the seal arrangement has a first condition in which a clearance fit between the components allows free movement. This simplifies the assembly process, and also allows a tool to slide and/or rotate during run-in on a tubular. The invention may be applied to a variety of tools, including packers, centralisers, stabilisers, collars, and joints.

What is claimed is:

1. A downhole apparatus for location on a tubular, the apparatus comprising:

a body having a throughbore configured to receive a tubular; and at least one swellable member comprising:

a material selected to expand upon exposure to at least one predetermined fluid, wherein the swellable member is arranged to provide a seal between the body and a tubular on which it is located during use, wherein the downhole apparatus is configured such that the body is moveable on the tubular when the swellable member is not expanded.

2. The apparatus as claimed in claim 1, wherein the apparatus is sized for a clearance fit on a tubular when in a first condition in which the swellable member is not expanded.

3. The apparatus as claimed in claim 1, wherein the apparatus is configured to rotate on a tubular.

4. The apparatus as claimed in claim 1, wherein the at least one swellable member is configured to extend around the tubular during use.

5. The apparatus as claimed in claim 1, further comprising a plurality of swellable members, which together extend around the tubular in use to create a seal.

6. The apparatus as claimed in claim 1, further configured such that the at least one swellable member is disposed at least partially between the body and tubular in use.

7. The apparatus as claimed in claim 1, wherein the body comprises one or more formations in which the at least one swellable member is located.

8. The apparatus as claimed in claim 7, wherein the one or more formations comprise an annular recess in the inner diameter of the throughbore.

9. The apparatus as claimed in claim 1, wherein the body further comprises:

a first portion;

a second portion longitudinally spaced from the first portion; and one or more joining portions configured to join the first and second portions.

10. The apparatus as claimed in claim 9, wherein the one or more joining portions is of unitary construction with at least one of the first or second portions.

11. The apparatus as claimed in claim 9, wherein the one or more joining portions has an inner diameter greater than the inner diameter of the first and second portions.

12. The apparatus as claimed in claim 9, wherein the one or more joining portions comprises one or more fingers.

13. The apparatus as claimed in claim 12, wherein the one or more fingers are configured to provide stand off protection to the tubular in use.

14. The apparatus as claimed in claim 12, wherein one or more fingers are configured to flex or deform on exposure to a radial or axial load.

15. The apparatus as claimed in claim 9, wherein the one or more joining portions comprises a joining ring.

16. The apparatus as claimed in claim 1, wherein the body is provided with one or more support portions which partially define an inner surface of the body, and wherein the one or more support portions define formations in which the swellable member is received.

17. The apparatus as claimed in claim 1, wherein a second swellable member is configured to provide a second seal that provides isolation between an upper volume of an annulus of a wellbore located above the second seal and a lower volume of the annulus of the wellbore located below the second seal.

18. The apparatus as claimed in claim 17, configured to form a continuous ring around the circumference of the apparatus, to provide a seal between the tubular and a wellbore in which the tubular is located.

19. The apparatus as claimed in claim 1, further comprising:

a plurality of swellable members longitudinally spaced on the body.

20. The apparatus as claimed in claim 1, further comprising:

one or more swellable members disposed on the outer surface of the body.

21. The apparatus as claimed in claim 1, wherein the at least one swellable member is configured to form a seal over an opening to a volume between the body and a tubular on which the body is located in use.

22. The apparatus as claimed in claim 1, wherein the at least one swellable member is sized to form an interference fit with a formation in which the swellable member is received.

23. The apparatus as claimed in claim 1, wherein the at least one swellable member is sized to be flush with an inner profile of the body.

24. The apparatus as claimed in claim 1, wherein the apparatus is one or more of: an isolation tool, a centraliser, a stabiliser, an anchor, a hanging device, or a collar.

25. The downhole apparatus of claim 1, wherein the downhole apparatus is configured to slide on the tubular when the swellable member is not expanded.

26. A downhole assembly comprising:

a tubular; and an apparatus, the apparatus comprising:

a body; and at least one swellable member which comprises a material selected to expand upon contact with at least one predetermined fluid, wherein the tubular extends through a bore defined by the body, and wherein the swellable member is configured to provide a seal between the body and the tubular, wherein the apparatus is configured such that the body is moveable on the tubular when the at least one swellable member is not expanded.

27. The downhole assembly as claimed in claim 26, having a first condition in which the swellable member is not expanded, and a second condition in which the swellable member is expanded and the seal is provided.

28. The downhole assembly as claimed in claim 26, further comprising a plurality of apparatus according to claim 1.

29. The downhole assembly as claimed in claim 26, further comprising:

one or more stops mounted on the tubular to restrict axial movement of the apparatus on the tubular.

30. A method of forming a downhole assembly, the method comprising the steps of:

providing a body on a tubular, such that the tubular extends through a bore defined by the body;

running the tubular to a downhole location; and creating a seal between the body and the tubular by exposing a swellable member to at least one predetermined fluid to expand the member, wherein the body is moveable on the tubular prior to performing the act of creating a seal.

31. The method as claimed in claim 30, comprising the additional step of slipping the body onto the tubular at surface.

32. The method as claimed in claim 30, comprising the additional step of running the body to a downhole location with the tubular.

33. The method as claimed in claim 30, comprising the additional step of locating one or more stops on the tubular to restrict axial movement of the body on the tubular.

34. The downhole assembly of claim 26, wherein the apparatus is configured to slide on the tubular when the at least one swellable member is not expanded.

35. The method of claim 30, wherein the act of providing a body on a tubular comprises:

configuring the body to slide on the tubular prior to performing the act of creating a seal.

36. A downhole apparatus for location on a tubular, the apparatus comprising:

a body having a throughbore configured to receive a tubular; and at least one swellable member comprising:

a material selected to expand upon exposure to at least one predetermined fluid, wherein the at least one swellable member has a first condition in which the at least one swellable member is not expanded, and a second condition, in which the at least one swellable member is expanded providing a seal between the body and a tubular on which the body is located during use, and wherein a second swellable member is configured to provide a second seal that provides isolation between an upper volume of an annulus of a wellbore located above the second seal and a lower volume of the annulus of the wellbore located below the second seal.

37. A downhole apparatus for location on a tubular, the apparatus comprising:

a body having a throughbore configured to receive a tubular; and at least one swellable member comprising:

a material selected to expand upon exposure to at least one predetermined fluid, wherein the at least one swellable member has a first condition in which the at least one swellable member is not expanded, and a second condition, in which the at least one swellable member is expanded providing a seal between the body and a tubular on which the body is located during use, and further comprising a second swellable member wherein a second swellable member is configured to provide a seal between the tubular and a wellbore in which the tubular is located.

* * * * *